United States Patent [19]

Wagner et al.

[11] Patent Number: 4,823,747

[45] Date of Patent: Apr. 25, 1989

[54] CYLINDER HEAD CAMSHAFT MOUNTING ARRANGEMENT

[75] Inventors: Wolf-Dietrich Wagner, Stuttgart; Rolf Klumpp, Kernen; Thomas Hardt, Ostfildern, all of Fed. Rep. of Germany

[73] Assignee: Daimler-Benz Aktiengesellschaft, Stuttgart, Fed. Rep. of Germany

[21] Appl. No.: 127,464

[22] Filed: Dec. 2, 1987

[30] Foreign Application Priority Data

Dec. 2, 1986 [DE] Fed. Rep. of Germany ..... 3641129

[51] Int. Cl.[4] ..... F01L 1/04; F01L 1/26; F02F 1/24

[52] U.S. Cl. ..... 123/193 H; 123/90.27

[58] Field of Search ..... 123/90.27, 193 H, 195 A

[56] References Cited

U.S. PATENT DOCUMENTS

| | | | |
|---|---|---|---|
| 4,534,325 | 8/1985 | Tanaka | 123/195 A |
| 4,535,733 | 8/1985 | Honda | 123/90.44 |
| 4,537,166 | 8/1985 | Kimura et al. | 123/90.36 |
| 4,553,510 | 11/1985 | Yano et al. | 123/90.34 |
| 4,572,117 | 2/1986 | Yoshikawa . | |
| 4,621,597 | 11/1986 | Kawada et al. | 123/193 H |
| 4,729,349 | 3/1988 | Sonoda et al. | 123/90.34 |
| 4,739,735 | 4/1988 | Ichida et al. | 123/193 H |

FOREIGN PATENT DOCUMENTS

| | | | |
|---|---|---|---|
| 2342530 | 5/1974 | Fed. Rep. of Germany . | |
| 3306355 | 8/1984 | Fed. Rep. of Germany . | |
| 1511082 | 1/1968 | France . | |
| 0025006 | 2/1984 | Japan | 123/90.27 |
| 1256401 | 12/1971 | United Kingdom . | |

*Primary Examiner*—Willis R. Wolfe
*Assistant Examiner*—M. Macy
*Attorney, Agent, or Firm*—Barnes & Thornburg

[57] ABSTRACT

The invention relates to a device for mounting two camshafts in the cylinder head of a multi-cylinder in-line internal combustion engine having especially four valves per cylinder, the device comprising bearing housings supported on the cylinder-head housing. To make it possible to provide a cylinder head with small valve angles and with more than four cylinder-head screws per cylinder, the bearing housings are accommodated in a camshaft bearing frame consisting of longitudinal and transverse webs and produced separately from the cylinder-head housing.

11 Claims, 2 Drawing Sheets

CYLINDER HEAD CAMSHAFT MOUNTING ARRANGEMENT

BACKGROUND AND SUMMARY OF THE INVENTION

The invention relates to a device for mounting two camshafts,in the cylinder head of a multi-cylinder in-line internal combustion engine of the type having four valves per cylinder.

On internal combustion engines with two overhead camshafts, there is generally a problem in arranging the cylinder-head screws in the cylinder-head housing in such a way that, whilst at the same time as symmetrical a hole pattern as possible is preserved, they are still accessible from the topside of the cylinder head.

To ensure this, it has already been proposed in German Patent Specification 2,324,530, for an internal combustion engine with a device of the relevant generic type, to arrange the bearing housings of the camshafts in respective transverse mid-planes of the cylinders and the cylinder-head screws laterally relative to these on the insides of the camshafts, in a housing plane extending between the cylinders. However, the accessibility achieved thereby presupposes further constructive measures to ensure that the camshafts are at a considerable distance from one another, this being equivalent to a large valve angle, and that no more than four cylinder-head screws are necessary to fasten the cylinder head. The known device is therefore unsuitable for use in cylinder heads of diesel engines, since because of the compact combustion space required these can be designed only with relatively small valve angles and high combustion-space pressures and ideally need six cylinder-head screws in order to fasten the cylinder head.

An object on which the invention is based is, therefore, to develop the known device or camshaft mounting, so that the valve position and consequently the shape of the combustion space and the number and position of the cylinder-head screws can be selected freely, largely independently of the camshaft mounting.

According to the invention, this object is achieved by providing that the bearing housings form, together with longitudinal webs and transverse webs, a camshaft bearing frame which is separate from the cylinder-head housing and which can be screwed to the cylinder-head housing.

As a result of the invention, a separation of the camshaft mounting and the cylinder head is obtained in an advantageous way, thus resulting in a simplification of the basic cylinder-head body, since there is no need for the hitherto cast-in camshaft mounting. Because the camshaft mounting and the cylinder head are separated, the camshaft bearing frame can be machined separately from the cylinder head, thus making production more efficient as a result of the use of machine tools specially adapted for separate production cycles.

Another advantage is that the positions of the valves and the number and position of the cylinder-head screws are independent of the camshaft mounting, so that it is possible directly to produce cylinder heads with four valves per cylinder and small valve angles and with more than four cylinder-head screws, which are particularly suitable for use in diesel engines.

Since there is no need for a camshaft mounting in the cylinder head, the height of the basic cylinder-head body can be reduced by an amount corresponding approximately to the assembly dimensions of the bearing housings. In a cylinder head with guide housings for the valve tappets, this means, for example, that the parting plane for resting the cylinder-head cover can be shifted approximately level with the top edges of the guide housings.

Moreover, a further advantage of the invention is that, for a repair, the complete "camshaft mounting" unit can be exchanged, so that, in order to carry out adjustment work, there is no longer any need to remove the cylinder head, as has been necessary hitherto for this purpose.

Insofar as the bearing frame is produced as a casting which rests by means of the two longitudinal webs on the lateral housing walls of the cylinder head, a further advantage is that the oil supply to the camshaft bearing points can be transferred to the bearing frame by means of a groove or bore cast in the longitudinal webs, thus making it possible to do away with the otherwise customary oblong-hole bore in the cylinder head housing.

It is also advantageous that the bearing frame makes it unnecessary to carry out the boring of the cylinder-head end walls which has hitherto been required for the machining of the bearing housings in the cylinder head, thus at the same time ensuring simpler sealing between the cylinder head and cylinder-head cover.

Finally, yet another advantage is that the camshaft mounting and cylinder head can be preassembled independently of one another, the preassembly of the camshaft mounting also including the connection of the spur wheels and the setting of the control times, so that during final engine assembly it is then merely necessary to insert the camshaft mounting as a single unit into the cylinder head, thus in particular also simplifying the setting of the control times in comparison with the conventional double camshaft mounting.

Other objects, advantages and novel features of the present invention will become apparent from the following detailed description of the invention when considered in conjunction with the accompanying drawings.

DETAILED DESCRIPTION OF THE DRAWINGS

Figure 1:
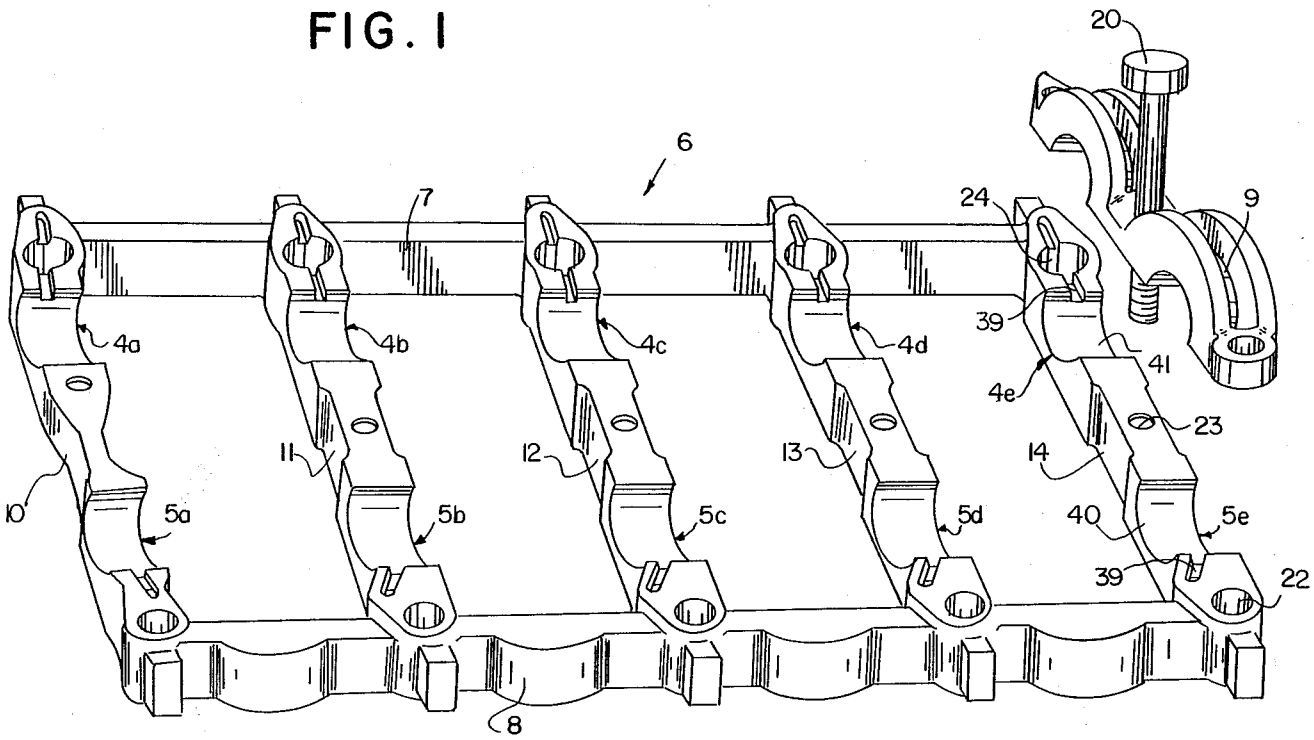
FIG. 1 shows a perspective representation of the camshaft bearing frame construction according to a preferred embodiment of the invention.
Figure 2:
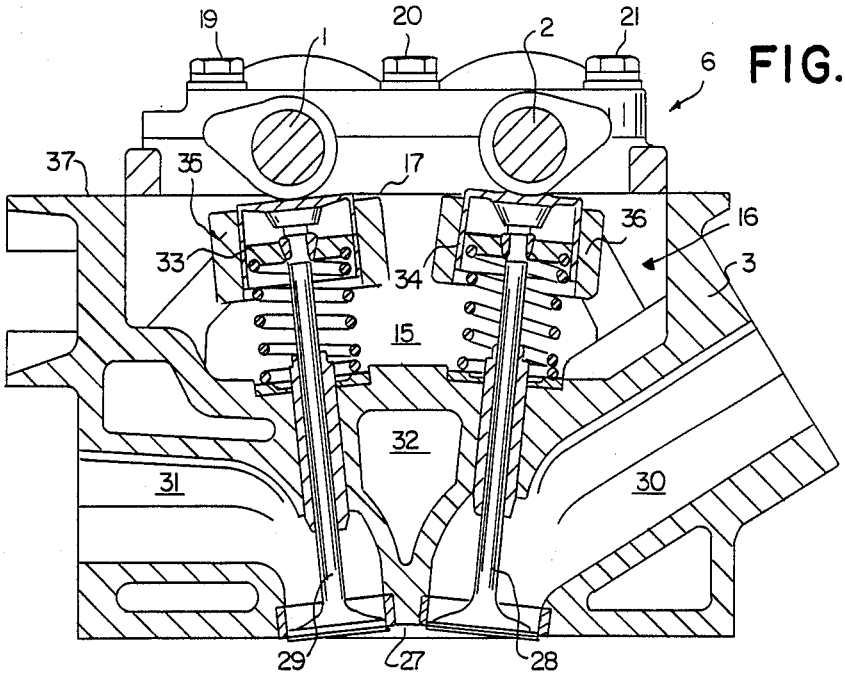
FIG. 2 shows a cross-section through a four-valve cylinder head for a diesel engine with a built-in camshaft bearing frame constructed according to a preferred embodiment of the invention.
Figure 3:
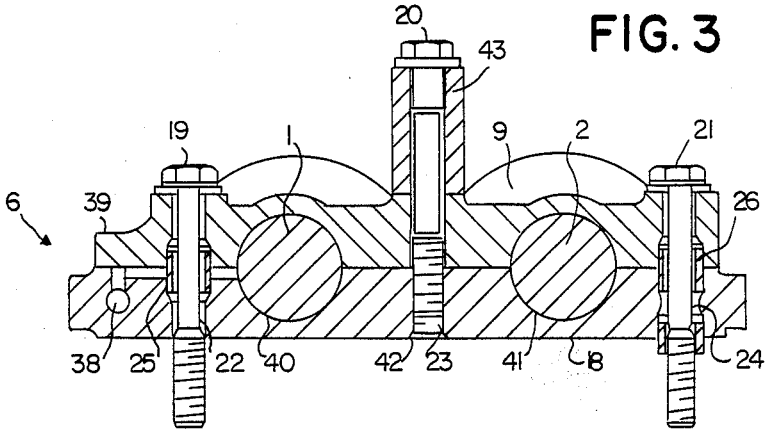
FIG. 3 shows the camshaft frame according to the invention, with a preassembled camshaft, in a cross-section through a transverse web.

A device for mounting two camshafts 1 and 2 in the cylinder head 3 of an in-line internal-combustion engine, not shown in any more detail, comprises several bearing housings 4*a* to 4*e* and 5*a* to 5*e* which are arranged in a camshaft bearing frame 6 produced separately from the cylinder head 3. The camshaft bearing frame 6 shown in FIG. 1 for a four-cylinder internal combustion engine consists of a casting with two longitudinal webs 7 and 8 extending parallel to one another in the longitudinal direction of the cylinder head and connected to one another by means of at least two transverse webs, and of the bearing housings 4*a* to 4*e* formed at the inside of the longitudinal web 7 and the bearing housings 5*a* to 5*e* formed at the inside of the longitudinal web 8. The bearing housings can be designed as individual housing rings fastened to the longitudinal webs 7 and 8, or in contrast to this the bearing housings located opposite one another in each transverse cylinder-head plane can be connected to form a pair of bearing housings which at the same time forms a respective transverse web of the bearing frame 6.

In the exemplary embodiment of FIG. 1, the bearing housings arranged in a particular transverse cylinder-head plane, as shown by the example of the bearing housings 4*e* and 5*e*, are connected to one another and divided into a common bearing bottom part and a common bearing cover 9. The bearing bottom parts obtained as a result of the division of the bearings at the same time form the transverse webs 10 to 14. The bearing frame 6 extends over the entire length of the cylinder head 3, to the outer transverse webs 10 and 14 being supported on the cylinder head 3 directly on the inside next to the respective end housing walls. The distances between the transverse webs 11 to 13 located between them are matched to the distances between the cylinders, and they each span the cylinder-head housing 3 in a transverse cylinder-head plane extending between the cylinders.

To guarantee a firm support of the bearing frame 6 in the cylinder head 3, transverse walls 16 are drawn in between the cylinders in the control space 15 and, towards the top side of the cylinder head, have plane-machined supporting faces 17, onto which the bearing frame 6 is placed by means of the transverse webs 10 to 14, the undersides 18 of which are likewise machined plane. The bearing frame 6, together with the bearing covers 9, is fastened to the cylinder head 3 on the transverse walls 16 via each transverse web 10 to 14 by means of three screws bolts 19 to 21. These bolts are inserted into three respective through-bores 22 to 24 in the transverse webs 10 to 14 and the associated bearing covers 9 and are screwed into threaded bores in the transverse walls 16. To secure the bearing covers, the outer through-bores 22 and 24 are made stepped in order to receive fitting sleeves 25 and 26.

The cylinder head 3 consists of an integral casting which can be made of a material other than that of the camshaft bearing frame 6. For each cylinder, the cylinder head 3 contains a combustion space 27, two inlet valves 28 and two outlet valves 29, inlet and outlet channels 30 and 31 leading off from these, and a cooling-water space 32 which is continuous over all the cylinders and which is separated from the control space 15. The cylinder head 3 also possesses, for each cylinder, an injection-nozzle, prechamber-neck or spark-plug bore which opens centrally into the combustion space 27 between the inlet and outlet valves 28 and 29.

Since the camshaft mounting is separate from the cylinder head 3, the inlet and outlet valves 28 and 29 can be arranged inclined relative to one another at a small valve angle. Also independently of the camshaft mounting, the cylinder-head screws can be placed in the basic cylinder-head body with substantial freedom in terms of their number and position.

The inlet and outlet valves 28 and 29 are controlled directly from the camshafts 1 and 2 via tappets 33 and 34 which are inserted in guide housings 35 and 36 located inside the control space 15. Because the camshaft mounting and cylinder head are separated, the resting face 37 for the cylinder-head cover of the latter, this resting face hitherto being located above the bearing housings of the camshafts, can be lowered as far as the top edge of the guide housings 35 and 36, and for the purpose of joint machining the supporting face 17 and the resting face 37 are in one plane.

For supplying lubricating oil to the individual bearing housings 4*a* to 5*e*, in one of the longitudinal webs 7 or 8 there is a longitudinal bore 38 which is connected to an oil-carrying bore in the cylinder head 3 via a feed bore (not shown). Oil ducts 39 branch off from the longitudinal bore 38 in the region of the individual transverse webs 10 to 14 and open into the bearing bottom shells 40 and 41 of the bearing housings 4*a* to 5*e*.

As already mentioned, the two camshafts 1 and 2 are preassembled independently of the cylinder-head housing 3. In order to safeguard the preassembled installation position of the two camshafts in the bearing frame 6, the bearing covers are both braced against the transverse webs 10 to 14 by means of only one of the three screw bolts 19 to 21. In order, at the same time, to ensure that pressure is distributed as uniformly as possible over the two camshafts, the bearing covers are braced against the transverse webs by means of the screw bolts 20 arranged centrally between the bearing housings. For this purpose, the through-bore 23 in the transverse webs 10 to 14 is equipped with a thread 42, into which the screw bolts 20 are screwed after the camshafts 1 and 2 have been placed in the bearing frame 6 and after the bearing covers 9 have been attached. A slotted supporting sleeve 43 is then pushed round the particular bolt shank projecting upwards from the bearing covers 9, and after the screw bolts 20 have been tightened, the bearing covers 9 are tensioned against the transverse webs 10 to 14 by means of this supporting sleeve 43. Subsequently, the control wheels are mounted on the two camshafts 1 and 2 and the control times are set. The camshaft mounting prefabricated in this way is first fastened in the cylinder head 3 via the outer screw bolts 19 and 21. Then, the supporting sleeves 43 are removed and the screw bolts 20 screwed into a threaded bore in the transverse wall 16.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Device for mounting two camshafts on a cylinder head housing of a multi-cylinder in-line internal combustion engine having four valves per cylinder, the device comprising bearing housing areas for the two crankshafts which are supported on the cylinder-head housing in plural transverse web means located at approximately equal distances from one another along the line of cylinders, plural longitudinal web means connected to the transverse web means, and wherein the longitudinal web means and transverse web means form a camshaft bearing frame which is separate from the cylinder-head housing and which can be screwed to the cylinder-head housing.

2. Device according to claim 1, wherein the bearing housing areas are located at the transverse web means between the plural longitudinal web means.

3. Device according to claim 1, wherein each transverse web means contain a pair of bearing housing areas.

4. Device according to claim 1, wherein the bearing housing areas are divided into an upper bearing area in a bearing cover and a bottom bearing area in the transverse web means and in which there are through-bores in the bearing cover and the camshaft bearing frame for the insertion of screw bolts, via which the bearing cover can be screwed to the camshaft bearing frame and at the same time the camshaft bearing frame can be screwed to cylinder-head housing.

5. Device according to claim 1, wherein the camshaft bearing frame extends over the entire length of the cylinder-head housing, and wherein two of the transverse web means located at the ends of the camshaft bearing frame are located next to end housing walls of the cylinder-head housing, and wherein others of the transverse web means are located between cylinders.

6. Device according claim 1, wherein the camshaft bearing frame consists of a casting, the underside of which is machined plane, and wherein the camshaft bearing frame is tensioned against a machined supporting face on top of the cylinder-head housing and wherein said supporting face extends between the cylinders.

7. Device according to claim 6, wherein the machined plane underside surface of the camshaft bearing frame and the machined supporting face are in one horizontal plane.

8. Device according to claim 4, wherein, in order to retain camshafts when they are preassembled in the camshaft bearing frame, at least one of the through-bores is equipped with a thread, into which is screwed a screw bolt provided for fastening the camshaft bearing frame to the cylinder-head housing, and wherein a supporting sleeve is fitted round a bolt shank of a screw bolt above the bearing cover to keep the bearing cover pressed against the camshaft bearing frame in preassembled form for subsequent bolting to the cylinder head.

9. Device according to claim 8, wherein the thread is provided in a through-bore located in a mid-point of at least one transverse web means between the plural longitudinal web means.

10. Device according to claim 1, wherein in at least one of the longitudinal web means or transverse web means there are oil grooves from which oil ducts branch off to the pairs of bearing housings.

11. Device according to claim 9, wherein in at least one of the longitudinal web means or transverse web means there are oil grooves from which oil ducts branch off to the pairs of the bearing housings.

* * * * *